US005285756A

United States Patent [19]

Squires

[11] Patent Number: 5,285,756

[45] Date of Patent: Feb. 15, 1994

[54] GASEOUS FUEL INJECTION VALVE AND ACTUATOR

[75] Inventor: Vaughn A. Squires, Grove City, Pa.

[73] Assignee: Cooper Industries, Inc., Houston, Tex.

[21] Appl. No.: 991,686

[22] Filed: Dec. 16, 1992

[51] Int. Cl.[5] ..... F02M 61/16; B05B 1/30

[52] U.S. Cl. ..... 123/294; 123/508; 123/527; 239/533.2; 239/600

[58] Field of Search ..... 123/27 GE, 294, 470, 123/508, 509, 525, 526, 527; 239/88, 91, 132.5, 533.2, 533.7, 533.12, 600; 29/213.1

[56] References Cited

U.S. PATENT DOCUMENTS

| | | | |
|---|---|---|---|
| 4,272,027 | 6/1981 | Seilly et al. | 239/88 |
| 4,365,756 | 12/1982 | Fisher | 239/533.2 |
| 4,394,970 | 7/1983 | Hofmann et al. | 239/533.7 |
| 4,413,781 | 11/1983 | Iwata | 239/91 |
| 4,419,977 | 12/1983 | Hillebrand | 123/508 |
| 4,421,280 | 12/1983 | Lewis et al. | 239/132.5 |
| 4,503,826 | 3/1985 | Kessler et al. | 239/132.5 |
| 4,962,743 | 10/1990 | Perr et al. | 123/508 |
| 5,106,023 | 4/1992 | Bentley et al. | 239/533.2 |

OTHER PUBLICATIONS

Cook Manley Installation Brochure, Jan. 1991, pp. 1–4.

*Primary Examiner*—Willis R. Wolfe

*Attorney, Agent, or Firm*—Eddie E. Scott; Hubert E. Cox; Alan R. Thiele

[57] ABSTRACT

The improved fuel injection valve assembly includes a valve body adapted for mounting in a cylinder head of a reciprocating gas engine including a valve seat sealing between the cylinder head and the valve body; a valve stem with a frustoconical end portion sealingly engaging the valve seat with stem threads at the opposite end for a tappet nut; a spring biasing the frustoconical end portion into sealing engagement with the valve seat; a stem piston guiding the valve stem within the valve body; an annular seal sealing the annulus between the valve body and the stem piston; an oil permeable bushing with a lubricating fluid reservoir positioned between the stem piston and the valve body; a rocker arm pivotally mounted on a rocker arm support mounted on the cylinder head; a push rod engaging one end of the rocker arm; and a tappet button positioned on the opposite end of the rocker arm. This improved fuel injection valve assembly allows lateral removal of the tappet button from the rocker arm to allow the rocker arm to pivot to a first position allowing disconnection of the push rod from the rocker arm which allows the rocker arm to pivot to a second position allowing the fuel injection valve to be serviced in place or removed from the cylinder head for replacement without removing the rocker arm or rocker arm support.

20 Claims, 2 Drawing Sheets

GASEOUS FUEL INJECTION VALVE AND ACTUATOR

BACKGROUND

This invention relates generally to a fuel injection valve assembly for use in a reciprocating natural gas engine and more particularly to an improved fuel injection valve which allows servicing of the valve without removal of the rocker arm and improved service life for the valve.

In the operation of reciprocating engines that operate by internal combustion of gaseous fuels as natural gas, fuel injection valves are critical to smooth operation of the engine. Typically, each cylinder of such a reciprocating engine has a fuel injection valve communicating therewith, the operation of the fuel injection valve necessary for smooth, efficient operation of the engine.

These fuel injection valve assemblies require periodic repair and maintenance due to such problems as deterioration of valve stem packing. This type of injection valve often is not enclosed within a protective rocker cover and is therefore exposed to outside airborne particles of dirt and grit. Sometimes these particles will work down the fuel injection valve's exposed surfaces into the sealing surfaces and will either damage the seal or score the outside surface of the stem piston, creating a leak passage. These repairs are costly and time-consuming and require the removal of the entire valve assembly, including rocker arm, from the engine. This removal of the rocker arm and complete valve assembly increases the amount of engine downtime and requires the technician doing the repair to handle large, heavy components such as the rocker arms. The improved fuel injection valve of the present invention overcomes the deficiencies of the prior art and provides a fuel injection valve which prevents premature damage to seal and wear surfaces and allows repair of the fuel injection valve to be effected without requiring removal of the rocker arms or the entire fuel injection valve assembly.

An example of a prior fuel injection valve is the T. Z. Fisher U.S. Pat. No. 4,365,756 which shows a fuel injection valve with exposed spring and seal surfaces exposed to airborne dirt and grit.

SUMMARY

The improved fuel injection valve assembly of the present invention includes a valve body adapted for mounting in a cylinder head of a reciprocating gas engine including a valve seat positioned on the end of the cylindrical lower portion of the valve body, said valve seat sealing between said cylinder head and said valve body; a valve stem with a frustoconical end portion sealingly engaging the valve seat with stem threads at the opposite end of said valve stem; a spring biasing the frustoconical end portion of the valve stem into sealing engagement with the valve seat; a stem piston disposed between the valve stem and the valve body to guide the valve stem within the valve body; an annular seal sealing the annulus between the valve body and the stem piston; an oil permeable bushing positioned between the stem piston and the valve body with a lubricating fluid reservoir to provide lubrication to the stem piston and also the annular seal; a tappet nut threaded onto the valve stem threads; a rocker arm pivotally mounted on a rocker arm support mounted on the cylinder head; a push rod engaging one end of the rocker arm; and a tappet button positioned on the opposite end of the rocker arm. During normal operation, the pushrod engages the rocker arm causing the tappet nut to unseat the valve seat and allow gas to flow into the combustion chamber.

An object of the present invention is to provide an improved fuel injection valve assembly which allows servicing of the valve while in place without removal of the rocker arm and the handling of large, heavy components.

Another object of the present invention is to provide an improved fuel injection valve assembly which allows improved service life for the fuel injection valve assembly.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENT

Figure 1:
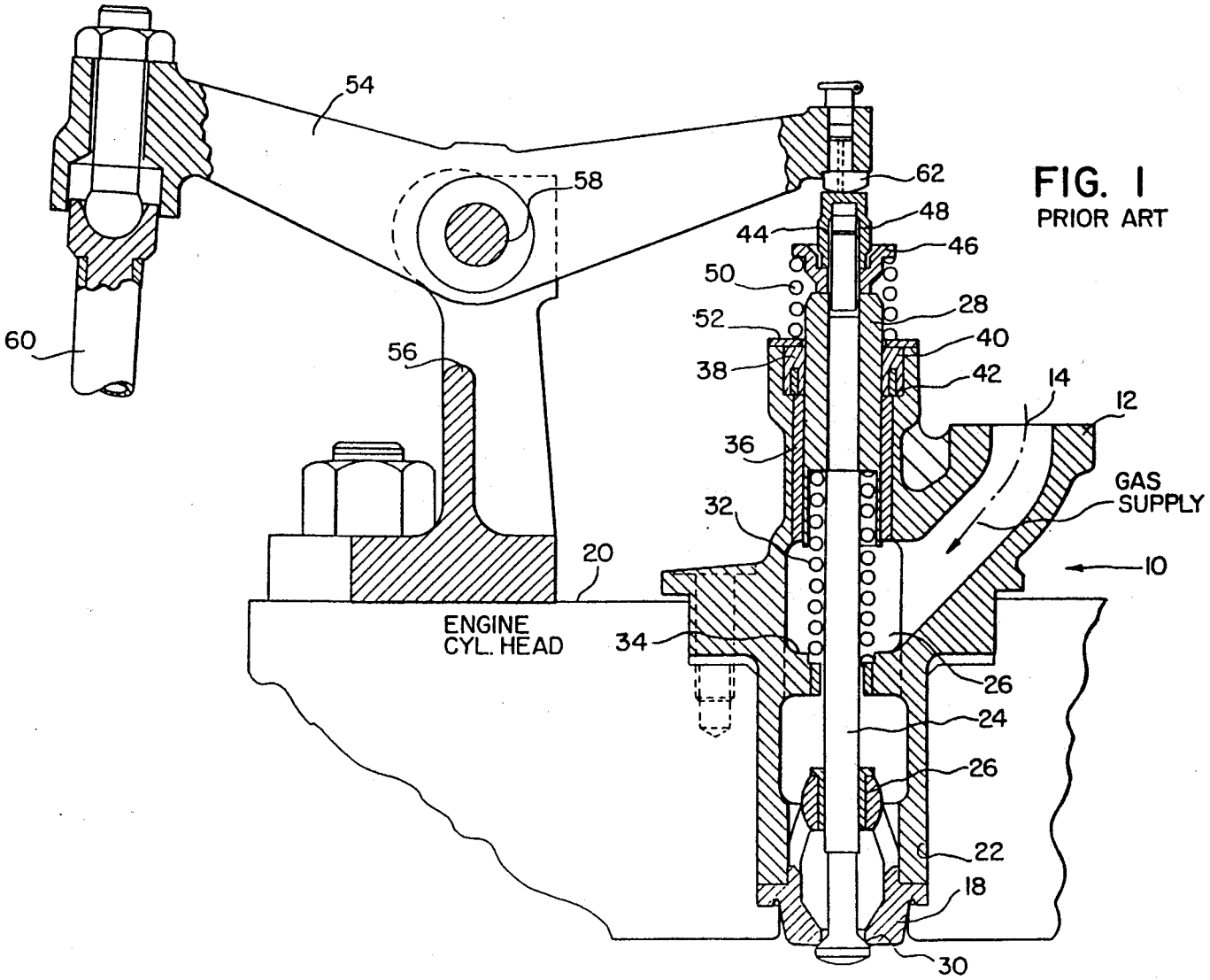
FIG. 1 PRIOR ART
FIG. 1 is an elevation view, partly in section, of a prior fuel injection valve assembly and rocker arm mounted on an engine.

With reference to FIG. 1, a prior art fuel injection valve assembly, denoted generally by numeral 10, is shown with the valve assembly in the closed position, i.e., no gaseous fuel is entering the engine. Fuel injection valve assembly 10 includes valve body 12 with gas supply port 14 communicating with valve chamber 16. Valve seat 18 is positioned below valve body 12 and seals between valve body 12 and cylinder head 20. Inlet passage 22 in cylinder head 20 communicates with the engine's combustion chamber (not shown). Valve stem 24 is centrally located within valve chamber 16 by lower bushing 26 and stem piston 28. Valve stem 24 has a frustoconical lower end 30 which seals against valve seat 18 to control the flow of gaseous fuel to the engine. The lower end of stem piston 28 is counterbored and receives spring 32 therein. Spring 32 cooperates with shoulder 34 of valve body 12 to bias stem piston 28 upwardly and thereby maintain frustoconical lower end 30 in sealing engagement with valve seat 18. Bushing 36 is a press fit in valve body 12 and acts to guide stem piston 28. Seal 38 prevents the leakage of gas by the upper exposed portion of stem piston 28. Seal 38 is of two part construction with an elastomeric body 40 of nitrile rubber and a metal insert ring 42. Threads 44 are formed on the upper end of valve stem 24 with spring nut 46 and tappet nut 48 threaded thereon. Upper spring 50 is positioned underneath spring nut 46 and reacts against cover plate 52 to further bias valve stem 24 to its closed position. Rocker arm 54 is positioned as shown on rocker arm support 56 with fulcrum pin 58 providing a rotating connection. One end of rocker arm 54 is activated by a rotating cam within the engine (not shown), pushing up on push rod 60. This causes tappet button 62 to push down on tappet nut 48, causing valve stem 24 to move downwardly, lifting frustoconical lower end 30 off valve seat 18. Springs 32 and 50 will close the valve after the cam has rotated past its lifting point.

The stem piston 28 passing through the center of the seal 38 strokes up and down during operation and due to the gripping of the seal, generates heat because of the surface friction. Should this temperature significantly exceed 250° F., the life of the seal is markedly decreased. This design provides no cooling benefits for the seal other than dissipating heat through the walls of the valve body. The lack of lubrication in this frictional mode is not helpful in promoting seal longevity. Another problem with this prior fuel injection valve is that it is not enclosed within a protective rocker cover and is exposed to outside airborne particles of dirt and grit.

Figure 2:
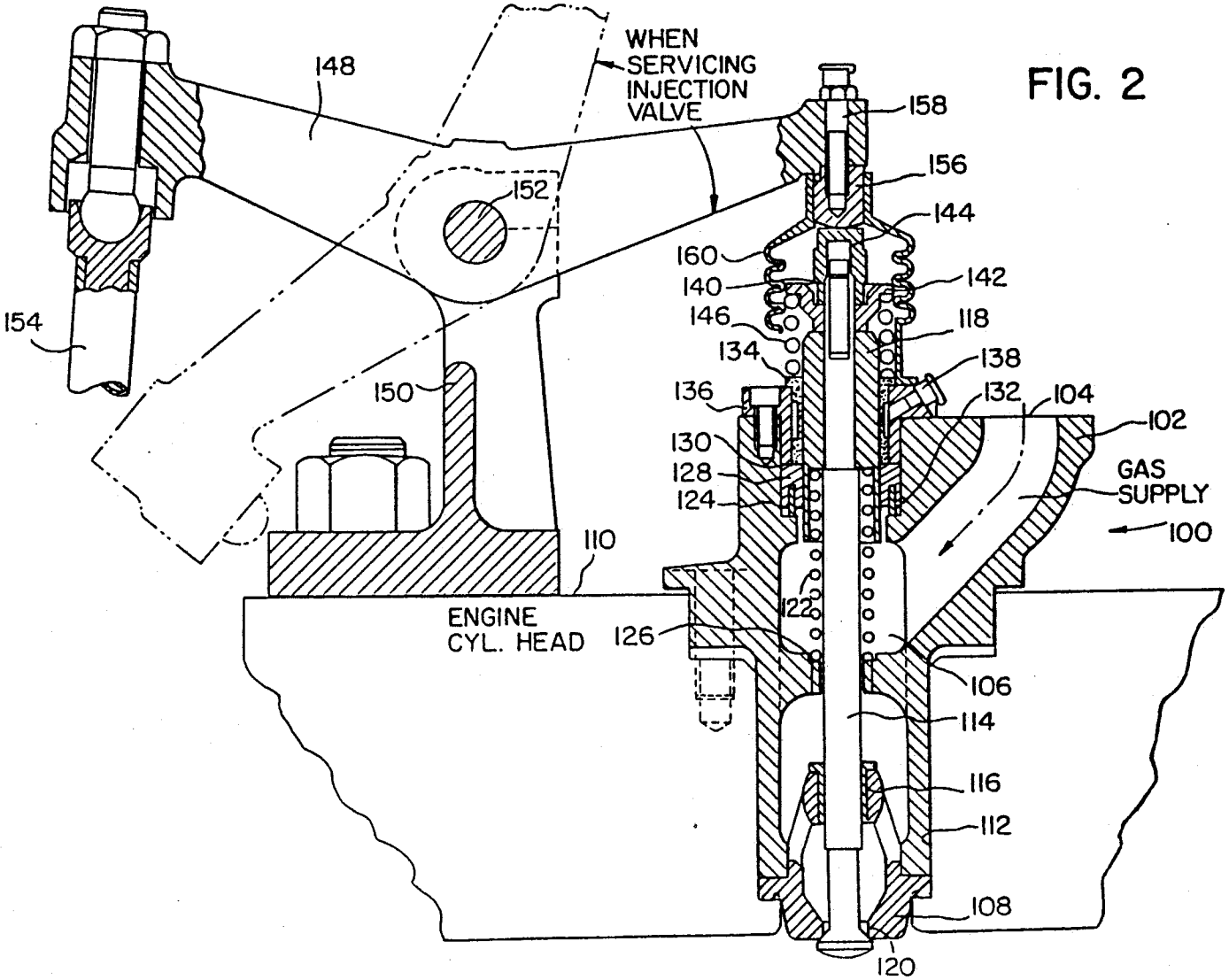
FIG. 2 is an elevation view, partly in section, of the improved fuel injection valve assembly and rocker arm of the present invention mounted on an engine.

The improved fuel injection valve assembly, denoted generally by numeral 100, is shown in FIG. 2 with the valve assembly in the closed position, i.e., no gaseous fuel is entering the engine. Fuel injection valve assembly 100 includes valve body 102 with gas supply port 104 communicating with valve chamber 106. Valve seat 108 is positioned below valve body 102 and seals between valve body 102 and cylinder head 110. Inlet passage 112 in cylinder head 110 communicates with the engine's combustion chamber (not shown). Valve stem 114 is centrally located within valve chamber 106 by lower bushing 116 and stem piston 118. Valve stem 114 has a frustoconical lower end 120 which seals against valve seat 108 to control the flow of gaseous fuel to the engine. The lower end of stem piston 118 is counterbored and receives spring 122 therein. The valve body 102 has an enlarged diameter adjacent the lower end of stem piston 118, forming a pocket 124 for purposes to be described hereinafter.

Spring 122 cooperates with shoulder 126 of valve body 102 to bias stem piston 118 upwardly and thereby maintain frustoconical lower end 120 in sealing engagement with valve seat 108. Seal 128 prevents the leakage of gas by the upper exposed portion of stem piston 118. Seal 128 is of two part construction with an elastomeric body 130 of nitrile rubber and a metal insert ring 132. Seal 128 is positioned in pocket 124 so that it may be cooled by the incoming natural gas supply which has been found to be at least 100° F. cooler than the normal operating temperature of the injection valve assembly 100 when assembled on an operating engine. Two features accomplish this cooling. The pocket 124 allows the seal 128 to be washed by the incoming natural gas supply and thereby cooled. Similarly, the counterbored lower end of stem piston 118 forms a thin sleeve or skirt which provides a cooling fin which is continually being washed by the incoming cool gas to dissipate the generated heat.

Sleeve bushing 134 is positioned above seal 128 and in combination with seal retainer 136 forms a reservoir for holding oil. Sleeve bushing 134 is composed of a sintered bronze material which allows oil in the reservoir to slowly migrate to the bearing contact surfaces. Seal retainer 136 has an oil cup 138 for adding new oil to the reservoir while the engine is in operation.

Threads 140 are formed on the upper end of valve stem 114 with spring nut 142 and tappet nut 144 threaded thereon. Upper spring 146 is positioned underneath spring nut 142 and reacts against sleeve bushing 134 to further bias valve stem 114 to its closed position. Rocker arm 148 is positioned as shown on rocker arm support 150 with fulcrum pin 152 providing a rotating connection. One end of rocker arm 148 is activated by a rotating cam within the engine (not shown), pushing up on push rod 154. This causes tappet button 156 to push down on tappet nut 144, causing valve stem 114 to move downwardly, lifting frustoconical lower end 120 off valve seat 108. Springs 122 and 146 will close the valve after the cam has rotated past its lifting point. Tappet button 156 is retained in rocker arm 148 by hollow bolt 158. Hollow bolt 158 has an oil cup on its top surface to allow oil to drip through a weep hole in tappet button 156 to lubricate the contact surfaces between tappet button 156 and tappet nut 144. Protective boot 160 is positioned about the upper end of stem piston 118 to prevent foreign matter from damaging the stem piston 118 or seal 128.

The fuel injection valve assembly 100 is easily serviced in the following manner. The tappet button 156 is removed sideways after removing the hollow bolt 158 which attaches the tappet button to the rocker arm 148. This creates a one inch gap between rocker arm 148 and tappet nut 144. The end of the rocker arm adjacent the fuel injection valve assembly 100 is pushed down, closing the one inch gap, thereby giving a one inch gap at the opposite end of the rocker arm. This allows the push rod 154 to be pushed sideways to miss the rocker arm 148, allowing the rocker arm 148 to pivot to almost a vertical position as shown in phantom in FIG. 2. This leaves the top of the fuel injection valve assembly 100 unobstructed for servicing without removing any other components.

The construction of my improved fuel injection valve assembly and the methods of its application will be readily understood from the foregoing description and it will be seen I have provided an improved fuel injection valve assembly which allows servicing of the valve without removal of the rocker arm and the handling of large, heavy components and provides improved service life for the fuel injection valve assembly. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A fuel injection valve assembly for use in a reciprocating gas engine, comprising:

a valve body adapted for mounting in a cylinder head of a reciprocating gas engine, said cylinder head communicating with a combustion chamber in said engine;

a valve seat sealing between said cylinder head and said valve body;

a valve stem with a frustoconical end portion sealingly engaging said valve seat and stem threads at the opposite end of said valve stem from said frustoconical end portion;

a spring maintaining said frustoconical end portion of said valve stem in sealing engagement with said valve seat, a stem piston annularly disposed between said valve stem and said valve body, guiding said valve stem within said valve body;

said stem piston and said valve body defining an annular volume therebetween to receive an annular seal sealing the annulus between said valve body and said stem piston, said annular seal positioned to allow the incoming fuel flow to cool the lower portion of said stem piston and said annular seal adjacent thereto.

2. A fuel injection valve assembly according to claim 1 including:

a rocker arm pivotally mounted on a rocker arm support, said rocker arm support mounted on said cylinder head;

a tappet nut threadably engaging said valve stem threads;

a tappet button positioned on a rocker arm which operates said fuel injection valve;

said tappet button laterally removable from said rocker arm to allow servicing of said fuel injection valve assembly without removing said rocker arm or said rocker arm support from said engine.

3. A fuel injection valve assembly according to claim 2 wherein lateral removal of said tappet button allows said rocker arm to pivot whereby said fuel injection valve is removable from said cylinder head without removing said rocker arm or said rocker arm support from said engine.

4. A fuel injection valve assembly according to claim 3 including an oil permeable bushing positioned between said stem piston and said valve body, said bushing including a lubricating fluid reservoir to provide lubrication to said stem piston and said annular seal.

5. A fuel injection valve assembly according to claim 4 including a counterbore in said stem piston, said counterbore sized to receive a second spring which further biases said valve stem in the closed position.

6. A fuel injection valve assembly according to claim 5 including a protective boot enclosing said tappet button and the upper portion of said fuel injection valve assembly to exclude any foreign matter.

7. A fuel injection valve assembly according to claim 6 wherein said annular seal includes a U shaped lower face, said U shaped lower face containing an annular metal support ring.

8. A fuel injection valve assembly according to claim 7 including a seal retainer, said seal retainer including a fluid access port for replenishing the lubricating fluid in said lubricating fluid reservoir.

9. A fuel injection valve assembly according to claim 8 including a guide bushing and a retainer positioned on said valve stem, said guide bushing therefore guiding the valve stem therethrough and cooperating with said retaining ring to prevent said valve stem from entering said engine during disassembly operations when said injection valve assembly is still assembled in said cylinder head.

10. A fuel injection valve assembly for use in a reciprocating gas engine, comprising:

a valve body adapted for mounting in a cylinder head of a reciprocating gas engine by installation of a cylindrical lower portion thereof into an opening in a cylinder head mounted on an engine, said opening leading to a combustion chamber in said engine;

a valve seat positioned on the end of said cylindrical lower portion of said valve body, said valve seat sealing between said cylinder head and said valve body;

a valve stem with a frustoconical end portion sealingly engaging said valve seat and stem threads at the opposite end of said valve stem from said frustoconical end portion;

an urging means maintaining said frustoconical end portion of said valve stem in sealing engagement with said valve seat, a stem piston disposed between said valve stem and said valve body, guiding said valve stem within said valve body;

an annular seal sealing the annulus between said valve body and said stem piston, an oil permeable bushing positioned between said stem piston and said valve body, said bushing including a lubricating fluid reservoir to provide lubrication to said stem piston and said annular seal;

a tappet nut threadably engaging said valve stem threads;

a rocker arm pivotally mounted on a rocker arm support, said rocker arm support mounted on said cylinder head;

a push rod engaging one end of said rocker arm; and a tappet button positioned on the opposite end of said rocker arm, said tappet button engaging said tappet nut to unseat said valve seat when actuated by said pushrod and allow gas to flow into said combustion chamber.

11. A fuel injection valve assembly according to claim 10 wherein said urging means includes a spring nut threadably engaging said stem threads and a spring retained by said spring nut to bias said valve stem in the closed position.

12. A fuel injection valve assembly according to claim 11 wherein said urging means further includes a counterbore in said stem piston, said counterbore sized to receive a second spring which further biases said valve stem in the closed position.

13. A fuel injection valve assembly according to claim 12 wherein said stem piston is positioned adjacent a fuel flow inlet port in said valve body, said valve body being adapted to provide an annular space between said stem piston and said valve body adjacent said fuel flow port to allow the incoming fuel flow to cool the lower portion of said stem piston and said annular seal adjacent thereto.

14. A fuel injection valve assembly according to claim 13 including a protective boot enclosing said tappet button and the upper portion of said fuel injection valve assembly to exclude any foreign matter.

15. A fuel injection valve assembly according to claim 14 wherein said tappet button may be removed laterally from said rocker arm to allow said rocker arm to pivot whereby said fuel injection valve is serviceable while in place or may be removed from said cylinder head without removing said rocker arm or said rocker arm support from the engine.

16. A fuel injection valve assembly according to claim 15 including a retaining ring positioned on said valve stem to prevent said valve stem from entering said engine during servicing operations.

17. A fuel injection valve assembly according to claim 16 wherein said annular seal includes a U shaped lower face, said U shaped lower face containing an annular metal support ring.

18. A fuel injection valve assembly according to claim 17 including a seal retainer, said seal retainer including a fluid access port for replenishing the lubricating fluid in said lubricating fluid reservoir.

19. A fuel injection valve assembly according to claim 18 including a guide bushing, said guide bushing guiding the valve stem therethrough and cooperating with said retaining ring to prevent said valve stem from entering said engine during servicing operations.

20. A method for servicing a pushrod actuated fuel injection valve mounted in cylinder head of a reciprocating gas engine without removing a rocker arm or a rocker arm support, comprising the steps of:

(a) removing a tappet button laterally from said rocker arm, (b) pivoting said rocker arm to a first position allowing disconnection of a pushrod from said rocker arm, (c) pivoting said rocker arm to a second position allowing said fuel injection valve to be serviced or removed from said cylinder head for replacement.

* * * * *